US011739972B2

(12) United States Patent
Takeuchi

(10) Patent No.: US 11,739,972 B2
(45) Date of Patent: Aug. 29, 2023

(54) AIR-CONDITIONING SYSTEM

(71) Applicant: Mitsubishi Electric Corporation, Tokyo (JP)

(72) Inventor: Katsuya Takeuchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 269 days.

(21) Appl. No.: 17/298,973

(22) PCT Filed: Mar. 4, 2019

(86) PCT No.: PCT/JP2019/008434
§ 371 (c)(1),
(2) Date: Jun. 2, 2021

(87) PCT Pub. No.: WO2020/178956
PCT Pub. Date: Sep. 10, 2020

(65) Prior Publication Data

US 2022/0065487 A1 Mar. 3, 2022

(51) Int. Cl.
*F24F 11/74* (2018.01)
*F24F 11/36* (2018.01)
*F24F 3/044* (2006.01)

(52) U.S. Cl.
CPC ..... *F24F 11/74* (2018.01); *F24F 3/044* (2013.01); *F24F 11/36* (2018.01)

(58) Field of Classification Search
CPC .. F24F 11/74; F24F 11/36; F24F 3/044; F24F 13/10; F24F 2140/40
See application file for complete search history.

(56) References Cited

U.S. PATENT DOCUMENTS

2014/0202336 A1* 7/2014 Benton ..... A61L 2/00 454/239
2016/0278696 A1* 9/2016 Ishibashi ..... A61B 5/7278
(Continued)

FOREIGN PATENT DOCUMENTS

JP 2002-372317 A 12/2002
JP 2005-188884 A 7/2005
WO 2018/207251 A1 11/2018

OTHER PUBLICATIONS

International Search Report dated Apr. 2, 2019, issued in corresponding International Application No. PCT/JP2019/008434 (and English Machine Translation).

*Primary Examiner* — Nelson J Nieves
(74) *Attorney, Agent, or Firm* — Posz Law Group, PLC

(57) ABSTRACT

An air-conditioning system includes an air-conditioning apparatus that includes a refrigerant circuit in which an indoor unit and an outdoor unit are connected to each other by a refrigerant pipe and inflammable refrigerant flows in the refrigerant pipe, and is configured to supply conditioned air to a plurality of areas corresponding to air-conditioned spaces, an air-conditioning duct that connects the indoor unit to the plurality of respective areas, a plurality of dampers that are arranged in the air-conditioning duct and openable and closable to interrupt or pass the conditioned air supplied to the plurality of respective areas, and a controller configured to control the dampers, in which the controller controls the dampers such that a total floor area of the areas to which the conditioned air is supplied is set as an area equal to or larger than a minimum floor area corresponding to a floor area with which an inflammable region is not formed even when the inflammable refrigerant is leaked.

3 Claims, 2 Drawing Sheets

(56) References Cited

U.S. PATENT DOCUMENTS

| | | | | |
|---|---|---|---|---|
| 2016/0327303 | A1* | 11/2016 | Tomita | G01N 25/50 |
| 2019/0137129 | A1* | 5/2019 | Zhou | F24F 13/02 |
| 2019/0145642 | A1* | 5/2019 | Heigl | F24F 11/0001 454/239 |
| 2019/0170375 | A1* | 6/2019 | Poerschke | F24F 13/10 |
| 2020/0056820 | A1* | 2/2020 | Suzuki | F25B 49/005 |
| 2020/0124299 | A1* | 4/2020 | Sugitani | F24F 11/74 |
| 2020/0292198 | A1* | 9/2020 | Funada | F24F 3/001 |
| 2021/0048199 | A1* | 2/2021 | Tamaki | F24F 1/0011 |
| 2021/0108819 | A1* | 4/2021 | Chen | F24F 3/001 |
| 2021/0172638 | A1* | 6/2021 | Sakurai | F24F 11/52 |
| 2021/0325081 | A1* | 10/2021 | Kagawa | F24F 1/16 |
| 2021/0372652 | A1* | 12/2021 | Liu | F25B 49/02 |
| 2021/0389004 | A1* | 12/2021 | Ashino | F24F 11/0001 |
| 2021/0404679 | A1* | 12/2021 | Hirai | F24F 11/46 |

* cited by examiner

AIR-CONDITIONING SYSTEM

CROSS REFERENCE TO RELATED APPLICATION

This application is a U.S. National Stage Application of International Application No. PCT/JP2019/008434, filed on Mar. 4, 2019, the contents of which are incorporated herein by reference.

TECHNICAL FIELD

The present disclosure relates to an air-conditioning system that includes an air-conditioning apparatus including a refrigerant circuit filled with inflammable refrigerant and is configured to individually condition air in a plurality of rooms using an air-conditioning duct and dampers.

BACKGROUND ART

Up to now, an air-conditioning system has been proposed in which a ceiling embedded type indoor unit is used as an indoor unit of an air-conditioning apparatus, and the indoor unit is installed above a ceiling to supply conditioned air to respective rooms via an air-conditioning duct (for example, see Patent Literature 1).

In the air-conditioning system of Patent Literature 1, inflammable refrigerant is used as refrigerant filled in a refrigerant circuit. A reason why the inflammable refrigerant is used as the refrigerant filled in the refrigerant circuit as described above is that a refrigerant such as R410A used mainly up to now is nonflammable but has a characteristic of a high global warming potential (GWP). This is also because as one of efforts to avoid global warming, actions are being taken to change the refrigerant from a refrigerant such as R410A having a high GWP to inflammable refrigerant having a lower GWP such as an R32 refrigerant.

CITATION LIST

Patent Literature

Patent Literature 1: Japanese Unexamined Patent Application Publication No. 2002-372317

SUMMARY OF INVENTION

Technical Problem

In the air-conditioning system in related art in which the inflammable refrigerant is used as the refrigerant filled in the refrigerant circuit as described in Patent Literature 1, in a case where the inflammable refrigerant is leaked in an indoor space, when the leaked refrigerant does not diffuse but remains, a gas phase at an inflammable concentration, in other words, an inflammable region may be formed in the indoor space. In a case where the inflammable refrigerant is leaked when air is conditioned in a narrow room such as a bedroom, the inflammable region is formed in the air-conditioned room. In a case where any potential ignition source exists in this inflammable region, a problem occurs that there is a danger that the inflammable refrigerant could catch fire.

The present disclosure has been made to solve the aforementioned problem, and aims at providing an air-conditioning system that can reduce risks of ignition of inflammable refrigerant.

Solution to Problem

An air-conditioning system according to an embodiment of the present disclosure includes an air-conditioning apparatus that includes a refrigerant circuit in which an indoor unit and an outdoor unit are connected to each other by a refrigerant pipe and inflammable refrigerant flows in the refrigerant pipe, and is configured to supply conditioned air to a plurality of areas corresponding to air-conditioned spaces, an air-conditioning duct that connects the indoor unit to the plurality of respective areas, a plurality of dampers that are arranged in the air-conditioning duct and openable and closable to interrupt or pass the conditioned air supplied to the plurality of respective areas, and a controller configured to control the dampers, in which the controller controls the dampers such that a total floor area of the areas to which the conditioned air is supplied is set as an area equal to or larger than a minimum floor area corresponding to a floor area in which an inflammable region is not formed even when the inflammable refrigerant is leaked.

Advantageous Effects of Invention

With the air-conditioning system according to the embodiment of the present disclosure, the dampers are controlled such that the total floor area of the areas to which the conditioned air is supplied is regularly set as the area equal to or larger than the minimum floor area corresponding to the floor area in which the inflammable region is not formed even when the inflammable refrigerant is leaked. For this reason, it is possible to suppress the formation of the inflammable region in the air-conditioned area, and risks of ignition of the inflammable refrigerant can be reduced.

DESCRIPTION OF EMBODIMENTS

Hereinafter, embodiments of the present disclosure will be described with reference to the drawings. It is noted that the present disclosure is not limited by the embodiments described below. In addition, in the following drawings, a size relationship between respective components may be different from an actual size relationship.

Embodiment 1

Embodiments of the present disclosure will be described hereinafter with reference to the drawings.

Figure 1:
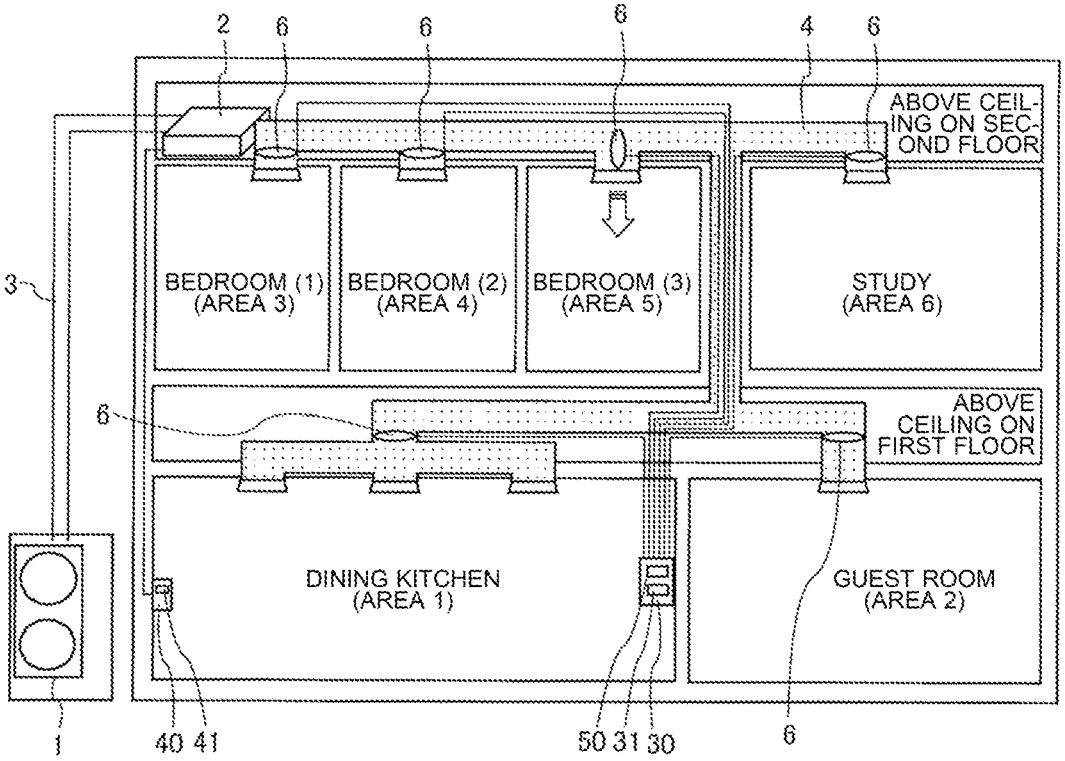
FIG. 1 is a schematic diagram for describing an air-conditioning system according to Embodiment 1 of the present disclosure.

FIG. 1 is a schematic diagram for describing an air-conditioning system according to Embodiment 1 of the present disclosure.

The air-conditioning system according to the present Embodiment 1 is configured to condition air in a house in which a plurality of rooms such as a bedroom, a study, and a dining kitchen are disposed as illustrated in FIG. 1.

The air-conditioning system includes an air-conditioning apparatus that includes a refrigerant circuit constituted by an outdoor unit 1 and an indoor unit 2 which are mutually connected by a refrigerant pipe 3 and is configured to supply conditioned air to a plurality of rooms corresponding to air-conditioned spaces. Herein, the indoor unit 2 is of a ceiling embedded type indoor unit used by being embedded in a ceiling. In addition, inflammable refrigerant such as R32 is used as the refrigerant filled in the refrigerant circuit.

Each of air outlets (not illustrated) of the conditioned air supplied from the indoor unit 2 is disposed in each room corresponding to the air-conditioned space. Then, the indoor unit 2 is connected to the respective air outlets by an air-conditioning duct 4 mainly installed above a ceiling.

Each of dampers 6 that are openable and closable to interrupt or pass the conditioned air supplied to the rooms is disposed near each air outlet in the air-conditioning duct 4. It is noted that installation locations and the number of the dampers 6 are not limited to the above, and can be optionally chosen.

In addition, the air-conditioning system includes a damper remote control 30 configured to control each of the dampers 6, and an air-conditioning apparatus remote control 40 configured to control an air-conditioning apparatus. The damper remote control 30 includes an operation unit 31 for a user to input a setting such as a room temperature setting. Similarly, the air-conditioning apparatus remote control 40 includes an operation unit 41 for the user to input a setting such as an opening and closing setting of the dampers 6. In addition, the air-conditioning apparatus remote control 40 includes the transmission unit 42 (see FIG. 2 which will be described below) configured to transmit control information of the dampers 6 to the damper remote control 30. In other words, the air-conditioning apparatus remote control 40 and the damper remote control 30 cooperatively operate, and each of the dampers 6 can be controlled from the air-conditioning apparatus remote control 40.

Then, when the user operates the operation unit 31 of the damper remote control 30 or the operation unit 41 of the air-conditioning apparatus remote control 40, each of the dampers 6 can be optionally opened and closed. In addition, when the user operates the operation unit 41 of the air-conditioning apparatus remote control 40, a temperature of each of the rooms can be set.

It is noted that the dampers 6 and the damper remote control 30 may cooperatively operate with the air-conditioning apparatus in a controlled manner, or may be an independent wire system without cooperatively operating with the air-conditioning apparatus.

In addition, the damper remote control 30 includes a controller 50. The controller 50 is configured, for example, by dedicated use hardware, or a central processing unit (CPU; also referred to as a central processing apparatus, a processing apparatus, a computing apparatus, a microprocessor, or a processor) configured to execute a program stored in a memory.

Figure 2:
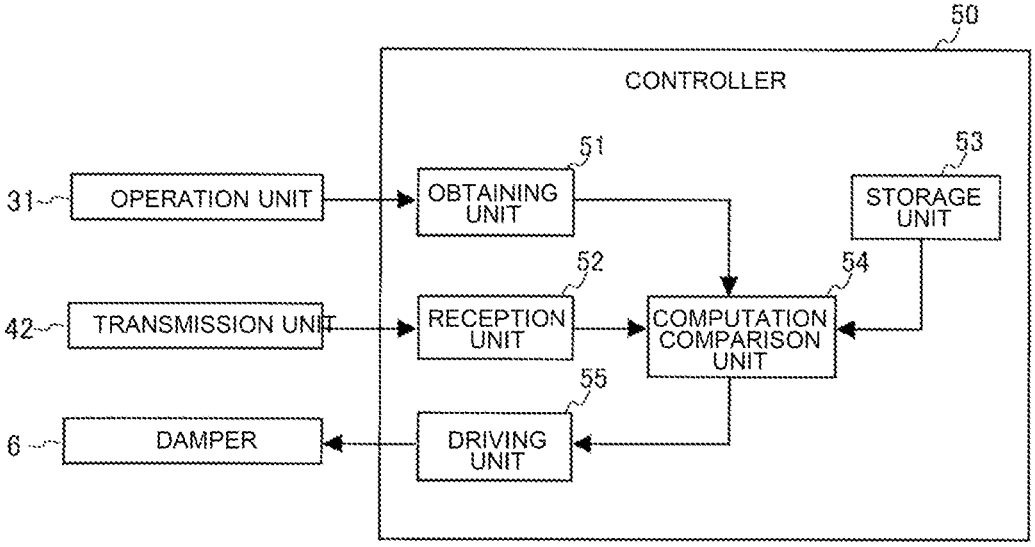
FIG. 2 is a functional block diagram of a controller of the air-conditioning system according to Embodiment 1 of the present disclosure.

FIG. 2 is a functional block diagram of the controller 50 of the air-conditioning system according to Embodiment 1 of the present disclosure.

As illustrated in FIG. 2, the controller 50 includes an obtaining unit 51, a reception unit 52, a storage unit 53, a computation comparison unit 54, and a driving unit 55.

The obtaining unit 51 is configured to obtain the information input from the operation unit 31. The reception unit 52 is configured to receive the control information of the dampers 6 transmitted from the transmission unit 42 of the air-conditioning apparatus remote control 40. The storage unit 53 is configured to store floor areas of respective areas which will be described below. The computation comparison unit 54 is configured to determine whether to open and close the dampers 6 from the information obtained from the obtaining unit 51 or the information received from the reception unit 52, and the information stored in the storage unit 53. The driving unit 55 is configured to open and close each of the dampers based on a result determined by the computation comparison unit 54.

Table 1 includes tables illustrating one example of previously set information from the air-conditioning apparatus remote control 40 or the damper remote control 30 in the air-conditioning system according to Embodiment 1 of the present disclosure. A top table illustrates setting contents, and a bottom table illustrates setting examples.

TABLE 1

| SYMBOL | UNIT | SETTING CONTENTS<br>CONTENTS TO BE SET |
|---|---|---|
| $A_{min}$ | $m^2$ | MINIMUM FLOOR AREA ACCORDING TO REFRIGERANT AMOUNT OF INSTALLED AIR-CONDITIONING APPARATUS |
| $A_n$ | $m^2$ | ACTUAL FLOOR AREA OF EACH ROOM |

SETTING EXAMPLE

| SYMBOL | UNIT | CONTENTS | INPUT VALUE |
|---|---|---|---|
| $A_{min}$ | $m^2$ | MINIMUM FLOOR AREA ACCORDING TO REFRIGERANT AMOUNT OF INSTALLED AIR-CONDITIONING APPARATUS | 24 |
| $A_1$ | $m^2$ | TOTAL FLOOR AREA OF AREA 1 | 10 |
| $A_2$ | $m^2$ | TOTAL FLOOR AREA OF AREA 2 | 8 |
| $A_3$ | $m^2$ | TOTAL FLOOR AREA OF AREA 3 | 6 |
| $A_4$ | $m^2$ | TOTAL FLOOR AREA OF AREA 4 | 6 |
| $A_5$ | $m^2$ | TOTAL FLOOR AREA OF AREA 5 | 6 |
| $A_6$ | $m^2$ | TOTAL FLOOR AREA OF AREA 6 | 8 |

A minimum floor area $A_{min}$ [$m^2$] illustrated in Table 1 is a minimum air-conditioned floor area that is restricted according to a refrigerant amount M [kg] filled in the refrigerant circuit of the air-conditioning apparatus installed in the house. Herein, an international standard (IEC 60335-2-40) or other standards describe that a minimum installation area A [$m^2$] of the indoor unit in the air-conditioning apparatus using the inflammable refrigerant is calculated from the refrigerant amount M [kg], an installation height $h_0$ [m], and a lean flammability limit LFL of the refrigerant. Similarly, in the international standard, with regard to the installation height $h_0$ [m], a minimum installation height is set depending on a mode of the indoor unit. For this reason, for example, when the installation height $h_0$ [m] is set as the minimum installation height, it is possible to calculate the minimum floor area $A_{min}$ [$m^2$] according to the refrigerant amount M [kg].

The minimum floor area $A_{min}$ [$m^2$] is a threshold set to avoid risks of ignition of the inflammable refrigerant, and in a case where the inflammable refrigerant is leaked into an area having a floor area smaller than the minimum floor area $A_{min}$ [$m^2$], a gas phase at an inflammable concentration, in other words, an inflammable region is formed in the area, and there is a fear that the inflammable refrigerant ignites. On the other hand, even when the inflammable refrigerant is leaked into an area having a floor area equal to or larger than the minimum floor area $A_{min}$, the inflammable region is not formed in the area. For this reason, a total of the floor areas of the air-conditioned areas needs to be equal to or larger than the minimum floor area $A_{min}$ to avoid the risks of the ignition of the inflammable refrigerant due to the formation of the inflammable region.

The minimum floor area $A_{min}$ [$m^2$] is information obtained from an installation manual or other documents of the air-conditioning apparatus installed in the house. In addition, a floor area $A_n$ (n=1, 2, 3, 4, . . . ) [$m^2$] of each of the air-conditioned areas is a total of the floor areas $A_n$ [$m^2$] of rooms corresponding to each of the dampers 6. Herein, the area refers to all the rooms corresponding to each of the dampers 6. In other words, in a case where the single damper 6 is installed for one room, the area is the floor area $A_n$ [$m^2$] of the one room, and in a case where the single damper 6 is installed for two rooms, the area is a combined value of the floor areas $A_n$ [$m^2$] of the two rooms. The floor area $A_n$ [$m^2$] of each area is mainly contents determined when the air-conditioning apparatus is installed, and the floor areas $A_n$ [$m^2$] of all the areas need to be previously set.

The minimum floor area $A_{min}$ [$m^2$] and the floor area $A_n$ [$m^2$] of each area are set from the air-conditioning apparatus remote control 40 or the damper remote control 30 by a work engineer. Then, the set minimum floor area $A_{min}$ [$m^2$] and the set floor area $A_n$ [$m^2$] of each area are stored in the storage unit 53.

Figure 3:
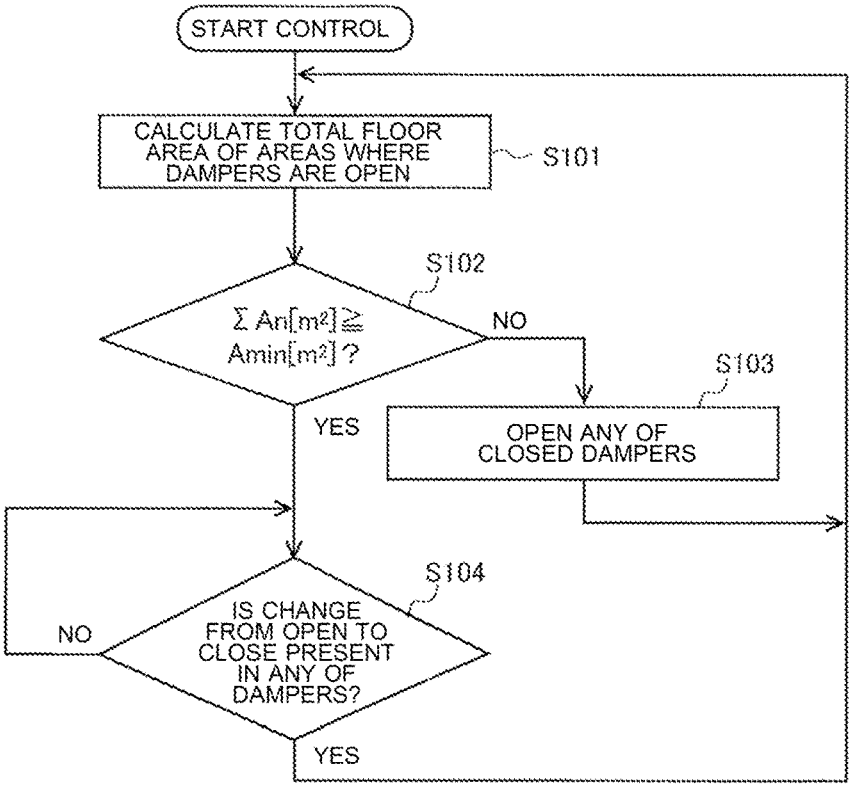
FIG. 3 is a diagram illustrating a control flow for opening and closing dampers of the air-conditioning system according to Embodiment 1 of the present disclosure.

FIG. 3 is a diagram illustrating a control flow for opening and closing the dampers 6 of the air-conditioning system according to Embodiment 1 of the present disclosure.

Hereinafter, the control flow for opening and closing the dampers 6 of the air-conditioning system according to Embodiment 1 of the present disclosure will be described with reference to FIG. 3.

(Step S101)

First, the computation comparison unit 54 refers to the storage unit 53, and calculates a total floor area $\Sigma A_n$ [$m^2$] of the areas where the dampers 6 are open.

(Step S102)

The computation comparison unit 54 compares the areas where the dampers 6 are open, in other words, the total floor area $\Sigma A_n$ [$m^2$] of the currently air-conditioned areas with the minimum floor area $A_{min}$ [$m^2$]. Then, it is determined whether or not the total floor area $\Sigma A_n$ [$m^2$] of the currently air-conditioned areas is equal to or larger than the minimum floor area $A_{min}$ [$m^2$]. In a case where the computation comparison unit 54 determines that the total floor area $\Sigma A_n$ [$m^2$] of the currently air-conditioned areas is equal to or larger than the minimum floor area $A_{min}$ [$m^2$] (Yes), the flow proceeds to the processing in step S104. On the other hand, in a case where the computation comparison unit 54 determines that the total floor area $\Sigma A_n$ [$m^2$] of the currently air-conditioned areas is smaller than the minimum floor area $A_{min}$ [$m^2$] (No), the flow proceeds to the processing in step S103.

(Step S103)

The driving unit 55 opens any one of the dampers 6 among the currently closed dampers 6, and the flow returns to the processing in step S101. It is noted that a configuration may also be adopted for opening a plurality of dampers 6 at the same time among the currently closed dampers 6.

(Step S104)

The computation comparison unit 54 determines whether a setting change from open to close is present or absent in any of the dampers 6. Herein, with regard to the determination on the presence or absence of the setting change of the dampers 6, for example, when the user performs the setting change of the dampers 6 by using the air-conditioning apparatus remote control 40 or the damper remote control 30, the information is stored in the storage unit 53, and the computation comparison unit 54 refers to the information to perform the determination. In a case where the computation comparison unit 54 determines that the setting change from open to close is present in any of the dampers 6 (Yes), the flow returns to the processing in step S101. On the other hand, in a case where the computation comparison unit 54 determines that the setting change from open to close is absent in any of the dampers 6 (No), the processing in step S104 is performed again.

In this manner, in the air-conditioning system according to the present Embodiment 1, the total floor area $\Sigma A_n$ [$m^2$] of the areas to which the conditioned air is supplied from the indoor unit 2 is regularly set not to be below the minimum floor area $A_{min}$ [$m^2$] by controlling opening and closing of the dampers 6. With this setting, if by any chance the inflammable refrigerant is leaked into the areas to which the conditioned air is supplied from the indoor unit 2, it is possible to suppress the formation of the inflammable region in the area, and the risks of the ignition of the inflammable refrigerant can be reduced.

It is noted that the air-conditioning system according to the present Embodiment 1 adopts a configuration provided with each of the air-conditioning apparatus remote control 40 and the damper remote control 30 as a separate component, but is not limited to the above-mentioned configuration. The air-conditioning system according to the present Embodiment 1 may also adopt a configuration provided with a single remote control in which a function of the air-conditioning apparatus remote control 40 is integrated with a function of the damper remote control 30.

As described above, the air-conditioning system according to the present Embodiment 1 includes the air-conditioning apparatus that includes the refrigerant circuit in which the indoor unit 2 and the outdoor unit 1 are connected to each other by the refrigerant pipe 3 and the inflammable refrigerant flows in the refrigerant pipe 3, and is configured to supply the conditioned air to the plurality of areas corresponding to the air-conditioned spaces. In addition, the air-conditioning system includes the air-conditioning duct 4 that connects the indoor unit 2 to the respective areas, the plurality of dampers 6 that are arranged in the air-conditioning duct 4 and openable and closable to interrupt or pass the conditioned air supplied to the plurality of respective areas, and the controller 50 configured to control the dampers 6. Then, the controller 50 controls the dampers 6 such that the total floor area $\Sigma A_n$ [$m^2$] of the areas to which the conditioned air is supplied is set as an area equal to or larger than the minimum floor area $A_{min}$ [$m^2$] corresponding to the floor area with which the inflammable region is not formed even when the inflammable refrigerant is leaked.

With the air-conditioning system according to the present Embodiment 1, the dampers 6 are controlled such that the total floor area $\Sigma A_n$ [$m^2$] of the areas to which the conditioned air is supplied is regularly set as the area equal to or larger than the minimum floor area $A_{min}$ [$m^2$] with which the inflammable region is formed due to the leakage of the inflammable refrigerant. For this reason, it is possible to suppress the formation of the inflammable region in the air-conditioned area, and the risks of the ignition of the inflammable refrigerant can be reduced.

In addition, in the air-conditioning system according to the present Embodiment 1, in a case where the setting change from open to close is present in any of the dampers 6, the controller 50 compares the total floor area $\Sigma A_n$ [$m^2$] with the minimum floor area $A_{min}$ [$m^2$].

With the air-conditioning system according to the present Embodiment 1, in a case where the setting change from open to close is present in any of the dampers 6, the total floor area $\Sigma A_n$ [$m^2$] is compared with the minimum floor area $A_{min}$ [$m^2$]. In other words, the total floor area $\Sigma A_n$ [$m^2$] is compared with the minimum floor area $A_{min}$ [$m^2$] at timing at which the total floor area $\Sigma A_n$ [$m^2$] is reduced. For this reason, opening and closing of the dampers 6 can be controlled at optimal timing, and even when the total floor area $\Sigma A_n$ [$m^2$] of the areas where the dampers 6 are open is lower than the minimum floor area $A_{min}$ [$m^2$], the total floor area can be immediately set to be equal to or larger than the minimum floor area $A_{min}$ [$m^2$].

Embodiment 2

Hereinafter, Embodiment 2 of the present disclosure will be described, but descriptions redundant to the descriptions on Embodiment 1 will be omitted, and the same components as the components of Embodiment 1 or equivalent components are assigned with the same reference signs.

Table 2 includes tables illustrating one example of a priority order $P_n$ of each of the areas set from the air-conditioning apparatus remote control 40 or the damper remote control 30 in the air-conditioning system according to Embodiment 2 of the present disclosure. A top table illustrates setting contents, and a bottom table illustrates setting examples.

TABLE 2

| SETTING CONTENTS | |
|---|---|
| AREA | PRIORITY ORDER |
| AREA n | $P_n$ |

| SETTING EXAMPLE | |
|---|---|
| AREA | PRIORITY ORDER |
| AREA 1 | $P_1$ |
| AREA 2 | $P_2$ |
| AREA 3 | $P_3$ |
| AREA 4 | $P_4$ |
| AREA 5 | $P_5$ |
| AREA 6 | $P_6$ |

As illustrated in Table 2, in the air-conditioning system according to the present Embodiment 2, the priority order $P_n$ (n=1, 2, 3, 4, . . . ) is set for each area. Herein, the priority order is $P_1>P_2>P_3>P_4>P_5>P_6$ in Table 2. In other words, $P_1$ indicates a highest priority order, and $P_6$ indicates a lowest priority order.

The priority order $P_n$ of each area is mainly set by the user from the air-conditioning apparatus remote control 40 or the damper remote control 30. Then, the set priority order $P_n$ of each area is stored in the storage unit 53. It is noted that the priority order $P_n$ of each area may be set by a work engineer or other people.

Figure 4:
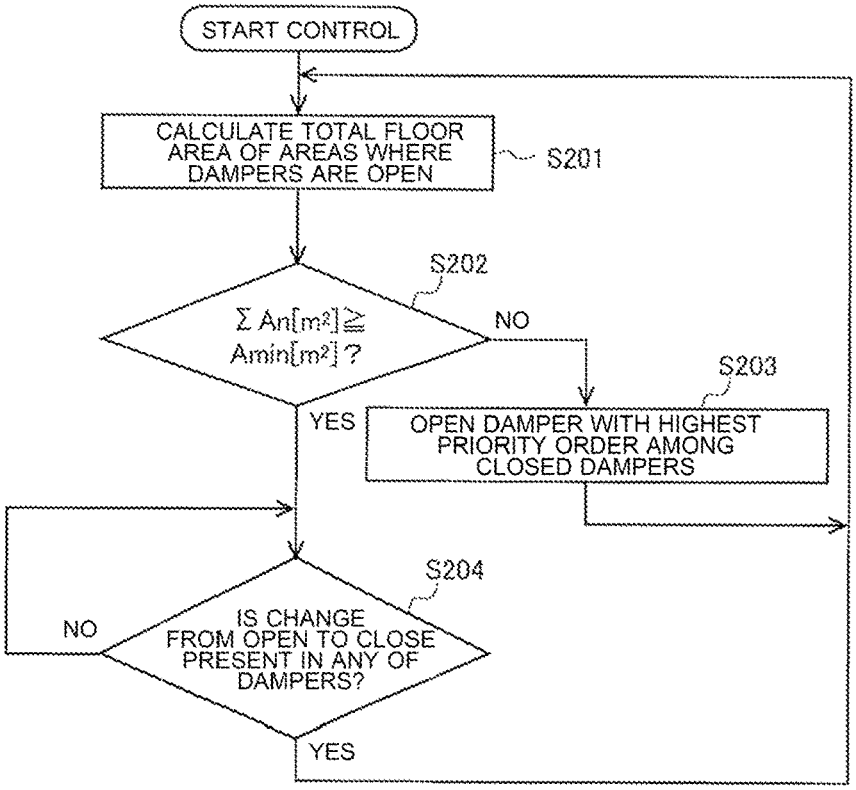
FIG. 4 is a diagram illustrating the control flow for opening and closing the dampers of the air-conditioning system according to Embodiment 2 of the present disclosure.

FIG. 4 is a diagram illustrating the control flow for opening and closing the dampers 6 of the air-conditioning system according to Embodiment 2 of the present disclosure.

Hereinafter, the control flow for opening and closing the dampers 6 of the air-conditioning system according to Embodiment 2 of the present disclosure will be described with reference to FIG. 4.

(Step S201)

First, the computation comparison unit 54 refers to the storage unit 53, and calculates the total floor area $\Sigma A_n$ [$m^2$] of the areas where the dampers 6 are open.

(Step S202)

The computation comparison unit 54 compares the areas where the dampers 6 are open, in other words, the total floor area $\Sigma A_n$ [$m^2$] of the currently air-conditioned areas with the minimum floor area $A_{min}$ [$m^2$]. Then, it is determined whether or not the total floor area $\Sigma A_n$ [$m^2$] of the currently air-conditioned areas is equal to or larger than the minimum floor area $A_{min}$ [$m^2$]. In a case where the computation comparison unit 54 determines that the total floor area $\Sigma A_n$ [$m^2$] of the currently air-conditioned areas is equal to or larger than the minimum floor area $A_{min}$ [$m^2$] (Yes), the flow proceeds to the processing in step S204. On the other hand, in a case where the computation comparison unit 54 determines that the total floor area $\Sigma A_n$ [$m^2$] of the currently air-conditioned areas is smaller than the minimum floor area $A_{min}$ [$m^2$] (No), the flow proceeds to the processing in step S203.

(Step S203)

The driving unit 55 refers to the storage unit 53 to open the damper 6 with the highest priority order $P_n$ among the currently closed dampers 6, and the flow returns to the processing in step S201. It is noted that if by any chance the priority order $P_n$ of the dampers 6 is not set by the user or other people, for example, a configuration may also be adopted in which the driving unit 55 opens the damper 6 in an area adjacent to the area where the damper 6 is open. In addition, for example, a configuration may also be adopted in which an initial value of the priority order $P_n$ of each area is previously stored in the storage unit 53, and the driving unit 55 opens the damper 6 determined based on the priority order $P_n$ at the initial value.

(Step S204)

The computation comparison unit 54 determines whether or not the setting change from open to close is present in any of the dampers 6. Herein, with regard to the determination on the presence or absence of the setting change of the dampers 6, for example, when the user performs the setting change of the dampers 6 by using the air-conditioning apparatus remote control 40 or the damper remote control 30, the information is stored in the storage unit 53, and the computation comparison unit 54 refers to the information to perform the determination. In a case where the computation comparison unit 54 determines that the setting change from open to close is present in any of the dampers 6 (Yes), the flow returns to the processing in step S201. On the other hand, in a case where the computation comparison unit 54 determines that the setting change from open to close is absent in any of the dampers 6 (No), the processing in step S204 is performed again.

Next, as one specific example, a control flow will be described in a case where from a state in which the dampers 6 in areas 1 to 3 are open as an initial setting, the damper 6 in the area 3 is closed in mid course.

In step S201, the computation comparison unit 54 refers to the storage unit 53, and calculates the total floor area $\Sigma A_n$ [$m^2$] of the areas where the dampers 6 are open. Herein, the areas where the dampers 6 are open are the areas 1 to 3, and the total floor area is calculated as follows $\Sigma A_n=A_1+A_2+A_3=24$ [$m^2$].

In step S202, the computation comparison unit 54 compares the total floor area $\Sigma A_n$ [$m^2$] of the areas 1 to 3 where the dampers 6 are open with the minimum floor area $A_{min}$ [$m^2$]. Herein, due to $\Sigma A_n=A_1+A_2+A_3=24$ [$m^2$] and the minimum floor area $A_{min}$=24 [m$^2$], $\Sigma A_n$ $A_{min}$ is satisfied. For this reason, the computation comparison unit 54 determines that the total floor area $\Sigma A_n$ [m$^2$] of the areas where the dampers 6 are open is equal to or larger than the minimum floor area $A_{min}$ [m$^2$], and the flow proceeds to the processing in step S204.

In step S204, the computation comparison unit 54 refers to the storage unit 53, and the processing in step S204 is repeated until the setting change from open to close is present in any of the dampers 6. Then, in a case where the computation comparison unit 54 determines that the setting change from open to close is present in the damper 6 in the area 3, the flow returns to the processing in step S201.

In step S201 again, the computation comparison unit 54 refers to the storage unit 53, and calculates the total floor area $\Sigma A_n$ [m$^2$] of the areas where the dampers 6 are open. Herein, the areas where the dampers 6 are open are the areas 1 and 2, the total floor area is calculated as follows $\Sigma A_n = A_1 + A_{2=18}$ [m$^2$].

In step S202 again, the computation comparison unit 54 compares the total floor area $\Sigma A_n$ [m$^2$] of the areas 1 and 2 where the dampers 6 are open with the minimum floor area $A_{min}$ [m$^2$]. Herein, due to $\Sigma A_n = A_1 + A_2 = 18$ [m$^2$] and the minimum floor area $A_{min}$=24 [m$^2$], $\Sigma A_n < A_{min}$ is satisfied. For this reason, the computation comparison unit 54 determines that the total floor area $\Sigma A_n$ [m$^2$] of the areas where the dampers 6 are open is smaller than the minimum floor area $A_{min}$ [m$^2$], and the flow proceeds to the processing in step S203.

In step S203, the computation comparison unit 54 refers to the storage unit 53. Then, among the currently closed dampers 6, in other words, the dampers 6 in areas 3 to 6, since the damper 6 with the highest priority order $P_n$ is the damper 6 in the area 4, the driving unit 55 opens the damper 6 in the area 4, and the flow returns to the processing in step S201.

In step S201 again, the computation comparison unit 54 refers to the storage unit 53, and calculates the total floor area $\Sigma A_n$ [m$^2$] of the areas where the dampers 6 are open. Herein, the areas where the dampers 6 are open are the areas 1, 2, and 4, and the total floor area is calculated as follows $\Sigma A_n = A_1 + A_2 + A_4 = 24$ [m$^2$].

In step S202 again, the computation comparison unit 54 compares the total floor area $\Sigma A_n$ [m$^2$] of the areas 1, 2, and 4 where the dampers 6 are open with the minimum floor area $A_{min}$ [m$^2$]. Herein, due to $\Sigma A_n = A_1 + A_2 + A_4 = 24$ [m$^2$] and the minimum floor area $A_{min}$=24 [m$^2$], $\Sigma A_n$ $A_{min}$ is satisfied. For this reason, the computation comparison unit 54 determines that the total floor area $\Sigma A_n$ [m$^2$] of the areas where the dampers 6 are open is equal to or larger than the minimum floor area $A_{min}$ [m$^2$], and the flow proceeds to the processing in step S204.

In step S204 again, the computation comparison unit 54 refers to the storage unit 53, and the processing in step S204 is repeated until the setting change from open to close is present in any of the dampers 6. Then, in a case where the computation comparison unit 54 determines that the setting change from open to close is present in any of the dampers 6, the flow returns to the processing in step S201.

In this manner, in the air-conditioning system according to the present Embodiment 2, opening and closing of the dampers 6 are controlled based on the previously set priority order $P_n$ of the dampers 6. For this reason, for example, the priority order $P_n$ of an area such as a dining kitchen where a person is often present is set to be high, and the priority order $P_n$ of an area such as a study where a person is less likely to be present is set to be low. With this setting, if by any chance the inflammable refrigerant is leaked, the leakage of the inflammable refrigerant into the area with the high priority order $P_n$ is suppressed, and it is possible to suppress the formation of the inflammable region, so that the risks of the ignition of the inflammable refrigerant can be reduced.

As described above, in the air-conditioning system according to the present Embodiment 2, the controller 50 compares the total floor area $\Sigma A_n$ [m$^2$] with the minimum floor area $A_{min}$ [m$^2$]. Then, in a case where the total floor area $\Sigma A_n$ [m$^2$] is below the minimum floor area $A_{min}$ [m$^2$], the damper 6 with the highest priority order $P_n$ that is previously set among the closed dampers 6 is opened.

With the air-conditioning system according to the present Embodiment 2, in a case where the total floor area $\Sigma A_n$ [m$^2$] is below the minimum floor area $A_{min}$ [m$^2$], the damper 6 with the highest priority order $P_n$ among the closed dampers 6 is opened. For this reason, if by any chance the inflammable refrigerant is leaked, the leakage of the inflammable refrigerant into the area with the high priority order $P_n$ is suppressed, and it is possible to suppress the formation of the inflammable region, so that the risks of the ignition of the inflammable refrigerant can be reduced.

REFERENCE SIGNS LIST

1: outdoor unit, 2: indoor unit, 3: refrigerant pipe, 4: air-conditioning duct, 6: damper, 30: damper remote control, 31: operation unit, 40: air-conditioning apparatus remote control, 41: operation unit, 42: transmission unit, 50: controller, 51: obtaining unit, 52: reception unit, 53: storage unit, 54: computation comparison unit, 55: driving unit

The invention claimed is:

1. An air-conditioning system comprising:

an air-conditioning apparatus that includes a refrigerant circuit in which an indoor unit and an outdoor unit are connected to each other by a refrigerant pipe and inflammable refrigerant flows in the refrigerant pipe, and is configured to supply conditioned air to a plurality of areas corresponding to air-conditioned space;

an air-conditioning duct that connects the indoor unit to the plurality of respective areas;

a plurality of dampers that are arranged in the air-conditioning duct and openable and closable to interrupt or pass the conditioned air supplied to the plurality of respective areas; and a controller configured to control the dampers, wherein the controller controls the dampers such that a total floor area of the areas to which the conditioned air is supplied is set as an area equal to or larger than a minimum floor area corresponding to a floor area with which an inflammable region is not formed even when the inflammable refrigerant is leaked, and wherein the controller compares the total floor area with the minimum floor area, and opens the dampers that are closed in a case where the total floor area is below the minimum floor area.

2. The air-conditioning system of claim 1, further comprising:

a remote control for a user to set the priority order of the dampers.

3. The air-conditioning system of claim 1, wherein the controller compares the total floor area with the minimum floor area in a case where a setting change from open to close is present in any of the dampers.

* * * * *